United States Patent [19]

Field

[11] Patent Number: 4,574,614

[45] Date of Patent: Mar. 11, 1986

[54] APPARATUS FOR REPAIRING AND STRAIGHTENING VEHICLES

[75] Inventor: Carl R. Field, Des Moines, Iowa

[73] Assignee: Duz-Mor, Inc., Des Moines, Iowa

[21] Appl. No.: 565,979

[22] Filed: Dec. 27, 1983

[51] Int. Cl.[4] ..... B21D 1/12

[52] U.S. Cl. ..... 72/447; 72/705

[58] Field of Search ..... 72/705, 447; 254/10 C

[56] References Cited

U.S. PATENT DOCUMENTS

| | | | |
|---|---|---|---|
| 2,451,307 | 10/1948 | South | 72/705 |
| 2,576,426 | 11/1951 | Thurzo | 254/10 C |
| 3,214,959 | 11/1965 | Bowden | 72/705 |
| 3,317,004 | 5/1967 | Harrison, Jr. | 254/10 C |
| 3,377,834 | 4/1968 | Latuff et al. | 72/705 |
| 3,888,100 | 6/1975 | Chisum | 72/705 |
| 4,158,303 | 6/1979 | Horn et al. | 72/705 |
| 4,344,314 | 8/1982 | Aldrich et al. | 72/705 |
| 4,404,838 | 9/1983 | Hare | 72/705 |
| 4,442,608 | 4/1984 | Clausen | 33/180 AT |

*Primary Examiner*—Lowell A. Larson

*Attorney, Agent, or Firm*—Henderson & Sturm

[57] ABSTRACT

A portable apparatus for repairing and straightening vehicles includes a cage structure having upper and lower spaced apart U-shaped tracks having forward and rearward ends. A plurality of tower assemblies are supported upon the tracks for movement therealong. A hydraulic power means is attached to the exterior of the tower for exerting a downward pulling force upon a tension member trained around a series of pulleys and attached to the damaged portion of the vehicle. The apparatus includes a lifting mechanism on a support surface for level uniform raising and lowering of the entire cage structure to provide access to the underneath side of the vehicle. Various brackets allow downward forces to be applied to the vehicle while an overhead hoist allows upward forces to be applied to the vehicle. A tie down bracket assembly is provided for clamping onto the rocker panels of a unibody vehicle for holding such a vehicle in place upon the supporting surface of the apparatus.

19 Claims, 20 Drawing Figures

APPARATUS FOR REPAIRING AND STRAIGHTENING VEHICLES

BACKGROUND OF THE INVENTION

The present invention is directed generally to an apparatus for repairing and straightening vehicles and more particularly to a passenger vehicle straightening apparatus adapted to provide for the facilitated entry of a car or truck therein and the application of forces from various directions to straighten the body thereof.

Several automobile body straightening apparatus are commercially available but these have several problems. Chisum U.S. Pat. No. 3,888,100 is an example of such an existing apparatus. The Chisum apparatus generally includes a plurality of towers movably positioned about a vehicle with each tower having a chain connected to the vehicle for exerting a pulling force toward the tower. The towers have been supported for revolution about a center pivot point, however, this arrangement does not accommodate proper positioning of the towers relative to an elongated vehicle body. FIG. 4 of Chisum shows a push rod 105 mounted on a cylinder 57 with a pull chain 102 anchored to a push rod cap means 103. The push rod turns a full 360° such that a pull can be exerted on the vehicle frame from any point around the tower. A ring means 123 may be rotated around the tower to position the chain at the desired location. The cylinder cannot be connected directly to the cap 103 since the lateral pull by the chain would damage the piston rod. Furthermore, the chain cannot be attached to the cylindrical means 113 since it needs to be movable around the tower. Approximately 20% of the power of the hydraulic cylinder is lost due to the friction between the push rod and the inside of the cylindrical means resulting from the lateral pressure created by the pull of the chain. Also, the length of the chain cannot be easily adjusted since the anchoring point at the cap 103 is too high to reach without a ladder. The ring means is a friction lock arrangement which is not positive and can walk up the tower. Likewise, the towers generally do not provide for the application of forces from sufficient heights to straighten certain body parts.

In straightening vehicles, it is often desirable to have access to the vehicle from below. Conventional straightening apparatus are therefore often placed over a pit which permits a person to get beneath the vehicle. Alternatively, apparatus installed on a flat floor often have a vertically adjustable ramp or the like that the vehicle is driven or winched up upon. Construction of pits in floors is costly as is the need for a winch to pull disabled vehicles upward on a ramp. Both the ramp and the pit arrangements limit practicality of the apparatus.

Newer unibody vehicles all present an additional problem in that there is no frame over which a chain can be strapped to tie the vehicle down to the apparatus.

These and other problems associated with the prior art are believed to be solved by the vehicle repairing and straightening apparatus of the present invention.

Accordingly, it is a primary objective of the present invention to provide an improved apparatus for repairing and straightening vehicles.

Another objective of the present invention is the provision of a vehicle straightening apparatus which can be installed on a flat floor and be uniformly raised and lowered.

A further objective is the provision of an apparatus for repairing and straightening vehicles having a tower assembly with a vertically oriented hydraulic cylinder mounted thereon which is extensible in a downward direction.

A further objective is to provide a vehicle straightening apparatus for use on passenger vehicles.

A further objective of the present invention is the provision of a portable vehicle straightening apparatus.

A still further objective of the present invention is the provision of a vehicle straightening apparatus including means for efficiently exerting pulling forces therefrom with a minimum loss of power.

Yet another objective of the present invention is the provision of a vehicle straightening apparatus which vehicles can easily enter and exit from.

A more specific objective is to provide a vehicle straightening apparatus including a two-tiered U-shaped track arrangement open at one end for the entry and exit of vehicles therethrough.

A further objective of the present invention is the provision of a vehicle straightening apparatus adapted for easy operation by one person.

A further objective of the present invention is the provision of a vehicle straightening apparatus for use on unibody vehicles.

A further objective of the present invention is the provision of a vehicle straightening apparatus with an overhead hoist movable along the length of the apparatus and from side to side thereon.

A further objective of the present invention is the provision of a vehicle straightening apparatus wherein pulling force is applied to the vehicle from the adjacent tower assemblies in a direction perpendicular to such tower assemblies.

A further objective of the present invention is the provision of a vehicle straightening apparatus wherein upward or downward pulling forces can be applied anywhere upon the vehicle.

Yet another objective of the present invention is the provision of a vehicle straightening apparatus wherein the pulling force applied to the vehicle equals the force developed in the hydraulic power cylinder.

Still another objective of the present invention is the provision of a vehicle straightening apparatus in which the displacement of the hydraulic power cylinder is equal to the displacement of the tension member, which is connected to the vehicle, to which the pulling force is applied.

These and other objectives of the present invention will be apparent to those skilled in the art from the following description of the invention.

SUMMARY OF THE INVENTION

The apparatus for repairing and straightening vehicles is of a cage construction and includes upper and lower I-beam tracks supported in vertically spaced relation by a frame and a plurality of tower assemblies movable about the tracks. The tracks and tower assemblies can be uniformly raised by means of hydraulic cylinders connected to the lower track member and to a pivotable arm which raise the tracks and tower assemblies when the hydraulic cylinders are extended. Safety legs are provided to maintain the structure at any selected height.

Each track including a pair of laterally spaced apart and longitudinally extending side members. The tracks are generally U-shaped so as to be open at the rearward end to provide for the entry of a vehicle into position between the side members. The plurality of tower assemblies are supported on the upper and lower tracks for longitudinal movement therealong. Each tower assembly includes a flexible tension member adapted for securement to a vehicle positioned between the side members of the tracks. A hydraulic cylinder mounted in a vertical orientation on the exterior of each tower assembly extends downwardly to pull the tension member, which is trained over the top of the tower, toward the assembly so as to straighten the vehicle. An overhead hoist is provided so that an upward pull can be exerted on the vehicle anywhere along its length or width, while selectively positioned lower pulleys allow a downward force to be applied anywhere along the length or width of the vehicle. Additional pulleys selectively positioned along each tower assembly permit other straightening forces to be applied to the vehicle. Tie down brackets are supplied to hold the vehicle securely in place upon the apparatus, including unibody vehicles.

DESCRIPTION OF THE PREFERRED EMBODIMENT

Figure 1:
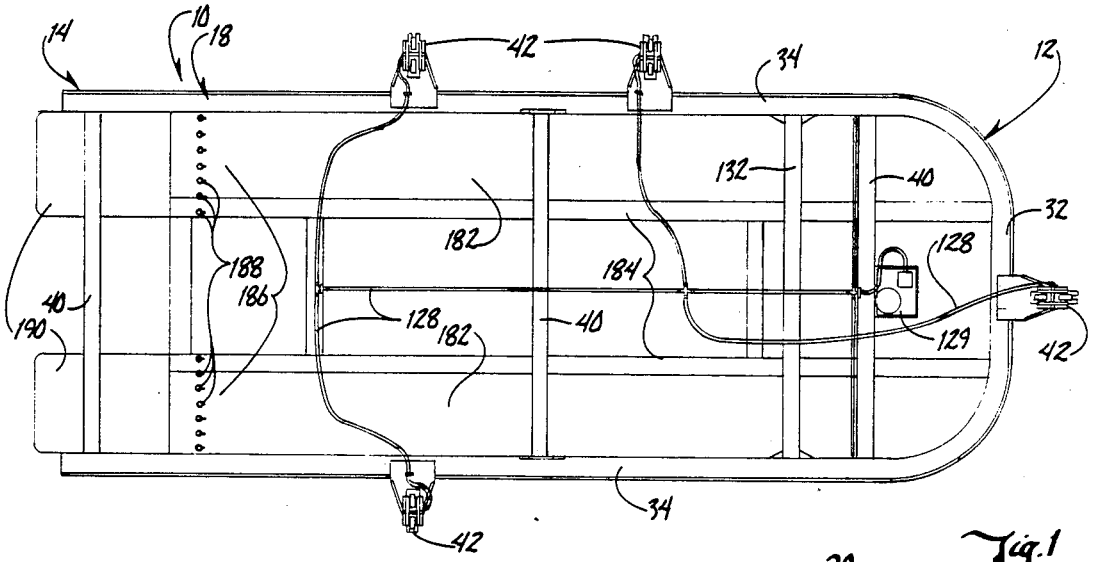
FIG. 1 is a top plan view of the vehicle straightening apparatus of the present invention.

The vehicle straightening apparatus of the present invention, indicated by the reference numeral 10 in FIG. 1, generally has a cage structure with a forward end 12 and an open rearward end 14 for entry of a vehicle 16 into apparatus 10. Apparatus 10 includes U-shaped upper and lower tracks 18 and 20, respectively, which are fixed in vertically spaced relation to one another by upright front frame members 22 and rear frame members 24.

Each track 12 and 14 is of an I-beam construction having an upper flange 26, a lower flange 28, and an interconnecting central web 30. Upper track 18 includes a laterally extending front cross member 32 and a pair of side members 34 connected to opposite ends of front cross member 32 and extending longitudinally rearwardly therefrom. Similarly, lower track 20 includes a laterally extending front cross member 36 and a pair of side members 38 connected to opposite ends of front cross member 36 and extending longitudinally rearwardly therefrom. Upper cross braces 40 may be provided between opposite side members 34 of upper track 18 to provide additional structural support to apparatus 10.

Apparatus 10 also includes a plurality of upright tower assemblies 42 which are movable along upper tracks 18 and 20. Each tower assembly is identical and includes a tubular tower frame 44 having an interior side 46, an exterior side 48, and opposite lateral sides 50. Tower frame 44 has a longitudinal slot 52 on the interior side 46 extending the length thereof, a slot 54 on exterior side 48 extending along the upper portion of the frame, and a plurality of aligned holes 56 in opposite sides 50 along the length thereof. The interior of tower frame 44 includes a pair of outwardly disposed C-shaped members 58 each fixed to one of opposite sides 50 and extending along the length thereof. Each C-member 58 also has a plurality of holes 60 along the length thereof which align with holes 56 in opposite sides 50. In cross-section, an I-shaped passageway 62 is provided on the interior of each tower frame 44.

To support each tower assembly 42 on the upper and lower tracks 18 and 20, the upper end of each tower frame 44 includes a pair of vertically spaced apart plates 64 and 66 which are welded to tower frame 44 and reinforced by vertical gussets 68. Top plate 64 includes a down-turned and exteriorally bent end portion 70 which rotatably supports a pair of longitudinally spaced apart rollers 72 on the exterior side thereof. Top flange 26 of upper track 18 has a vertically disposed plate 74 rigidly affixed thereto. Upper flange 26 of upper track 18 and plate 74 thus provide a guide surface upon which rollers 72 ride so as to support tower assembly 42 thereon. Lower plate 66 includes a pair of bolts 76 which extend therethrough. A small gap 78 is normally maintained between bolts 76 and lower flange 28 of upper track 18 such that tower assembly 42 is free to move along upper track 18. When tension is supplied from tower assembly 42 to vehicle 16, as hereinafter explained, bolts 76 frictionally engage lower flange 28 of upper track 18 to prevent movement of tower assembly 42 therealong.

The lower end of tower frame 44 includes a pair of vertically spaced apart plates 80 and 82 which rotatably support a pair of horizontally disposed rollers 84. Rollers 84 ride upon central web 30 of lower track 20 such that tower assembly 42 can move therealong. Upper flange 26 of lower track 20 includes a plurality of holes 86 along the exterior periphery therof. A pin 88 extends through one of holes 86 and through an aligned hole in upper plate 80 and is received in a recepticle 90 fixed to lower plate 82 to prevent lower end of tower assembly 42 from moving along lower track 20.

Fixed to the top end of each tower assembly 42 is a pulley support bracket 92 which rotatably supports a pair of laterally spaced apart pulleys 94. Pulley bracket 92 is rigidly secured to the top of tower frame 44. A tension member 96, such as a chain or cable or the like, is trained over the tops of pulleys 94 and has a first free end 98 and a second opposite end 100. First end 98 is connected to the damaged part of vehicle 16 while opposite end 100 is locked into an anchor bracket 102. Anchor bracket 102 includes a main body portion 104 and a T-shaped guide portion 106 extending through slot 54 on exterior side 48 of tower frame 44 and received in a portion of I-shaped passageway 62 therein for sliding movement therealong. Anchor bracket 102 has a pair of spaced apart ears 108 extending exteriorally therefrom and being adapted to lockingly receive a portion of tension member 96 therebetween. Tension member 96 thus extends upwardly from anchor bracket 102, over top pulleys 94 and downwardly along interior side 46 of tower frame 44.

An additional pulley assembly 110 is provided on the interior side 46 of tower frame 44 such that free end 98 can be selectively adjustably positioned with respect to vehicle 16. Pulley assembly 110 includes a pulley bracket 112 which rotatably supports a pulley 114. Pulley bracket 112 is pivotally connected to a cross-shaped stem 116 which extends through slot 52 on interior side 46 of tower assembly 44 and is matinglY received in a portion of I-shaped passageway 62 within tower frame 44. Pulley assembly 110 can thus be slidably moved along tower frame 44 and locked into the desired position by a pin 118 extending through the aligned holes 56 and 60 in tower frame 44 and through a hole 120 in stem 116 of bracket 112.

Each tower assembly 42 also has a hydraulic power means 122 fixed to the upper end thereof. Hydraulic power means 122 includes a conventional single acting hydraulic cylinder 124 with an extensible piston 126 projection therefrom. Cylinder 124 is secured to the upper end of tower frame 44 while the end of piston 126 engages or is attached to anchor bracket 102. A hydraulic fluid line 128 supplies hydraulic fluid to the interior of cylinder 124 from a source of hydraulic fluid 129. A valve 130 permits the pressure of hydraulic fluid within cylinder 124 to be regulated.

In the basic operation of apparatus 10, free end 98 of tension member 96 is attached to the damaged area of vehicle 16 while opposite end 100 is lockingly received by anchor bracket 102. Hydraulic power means 122 is then actuated to extend piston 126 from cylinder 124, thus slidling anchor bracket 102 downwardly within slot 54 in tower frame 44. Since tension member 96 is trained about pulleys 94 and 114, the downward movement of anchor bracket 102 causes free end 98 to be pulled toward tower assembly 42, thereby straightening vehicle 16. It is noted that the linear displacement of piston 126 is equal to the linear displacement of free end 98 of tension member 96. In addition to the 1:1 displacement ratio of piston 126 and free end 98 of tension member 96, the force developed within cylinder 124 during extension of piston 126 therefrom equals the force exerted on vehicle 16 by free end 98 of tension member 96. Thus, the size of hydraulic power means 122 can be minimized. Preferably, power means 122 is a ten ton hydraulic cylinder with a ten inch stroke.

Figure 18:
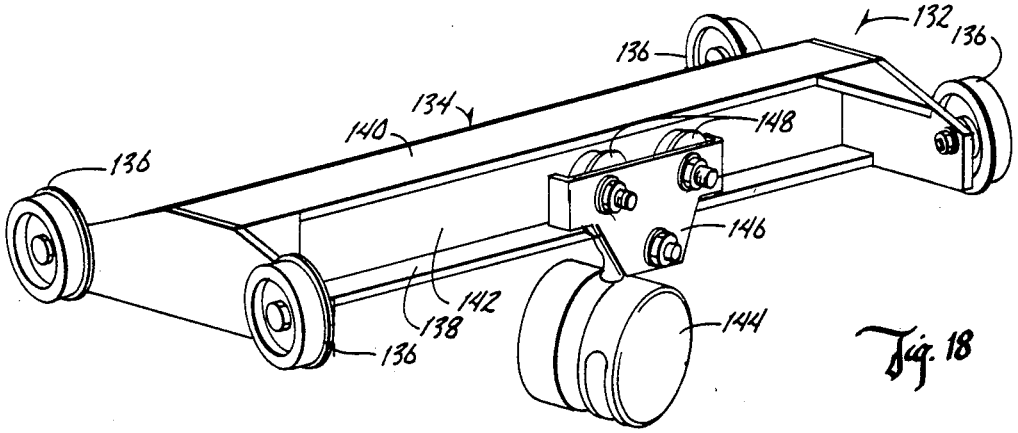
FIG. 18 is a perspective view of the overhead hoist.

Apparatus 10 includes an overhead hoist 132 which is movable from the forward end 12 to the rearward end 14 and from one side to another. As seen in FIG. 18, overhead hoist 132 includes a cross beam 134 which extends between side members 34 of upper track 18 and has a pair of rollers 136 rotatably mounted at each end which ride upon lower flange 28 of upper track 18, such that hoist 132 can move along the length of apparatus 10. Cross beam 134 is generally of an I-beam construction and includes a lower flange 138, an upper flange 140 and an interconnecting central web 142. Hoist 132 has a pulley 142 pivotally mounted upon a pulley bracket 146 which has a set of rollers 148 rotatably mounted thereon which ride upon lower flange 138 of cross beam 134 such that pulley 144 can be moved across the width of apparatus 10.

Figure 4:
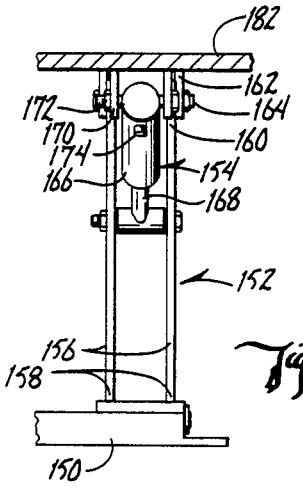
FIG. 4 is a front end elevation view showing one of the linkage arm connections of the lifting mechanism of the apparatus in a raised position.
Figure 5:
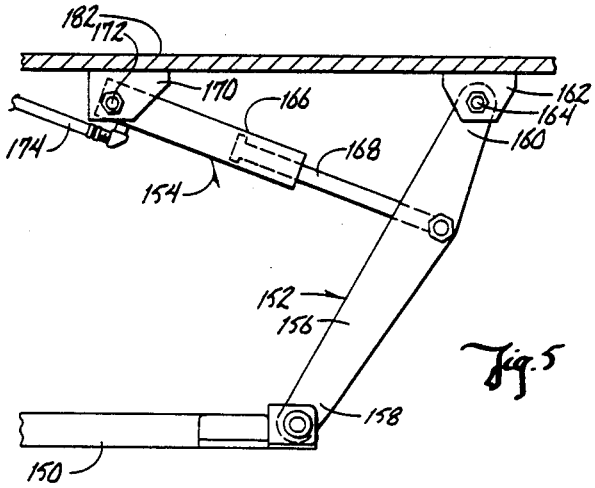
FIG. 5 is a side elevation view showing the linkage arm connection of the lifting mechanism of the apparatus in a raised position.

Apparatus 10 further includes a lifting mechanism for the level uniform raising and lowering of the cage structure. The lifting mechanism includes a floor engaging base 150, a plurality of arms 152 interconnecting base 150 with lower track 20 and a plurality of hydraulic power means 154 connected to lower track 20 and to each of arms 152. Base 150 is generally rectangular in shape and has approximately the same width of apparatus 10. One arm 152 is connected to each of the corners of base 150 and adjacent the approximate corners of apparatus 10. Each arm 152 includes a pair of spaced apart elongated plates 156 having lower ends 158 and upper ends 160. Lower ends 158 and upper ends 160 are pivotally connected to base 150 and lower track 20, respectively, in any convenient manner. For example, FIGS. 4 and 5 show upper end 160 of arm 152 being positioned between a pair of ears 162 fixed to lower track 20 and being held in place therebetween by a pin 164 extending therethrough.

Hydraulic power means 154 includes a conventional single acting cylinder 166 with an extensible piston 168 projecting therefrom. The outer extremity of cylinder 166 is pivotally connected to lower track 20 in any convenient fashion. Similarly, the outer extremity of piston 168 is pivotally attached to arm 152 in an appropriate manner. For example, cylinder 166 may extend between a pair of spaced apart ears 170 on lower track 20 and be held in place thereon by a pin 172 extending therethrough, as seen in FIG. 4.

Figure 2:
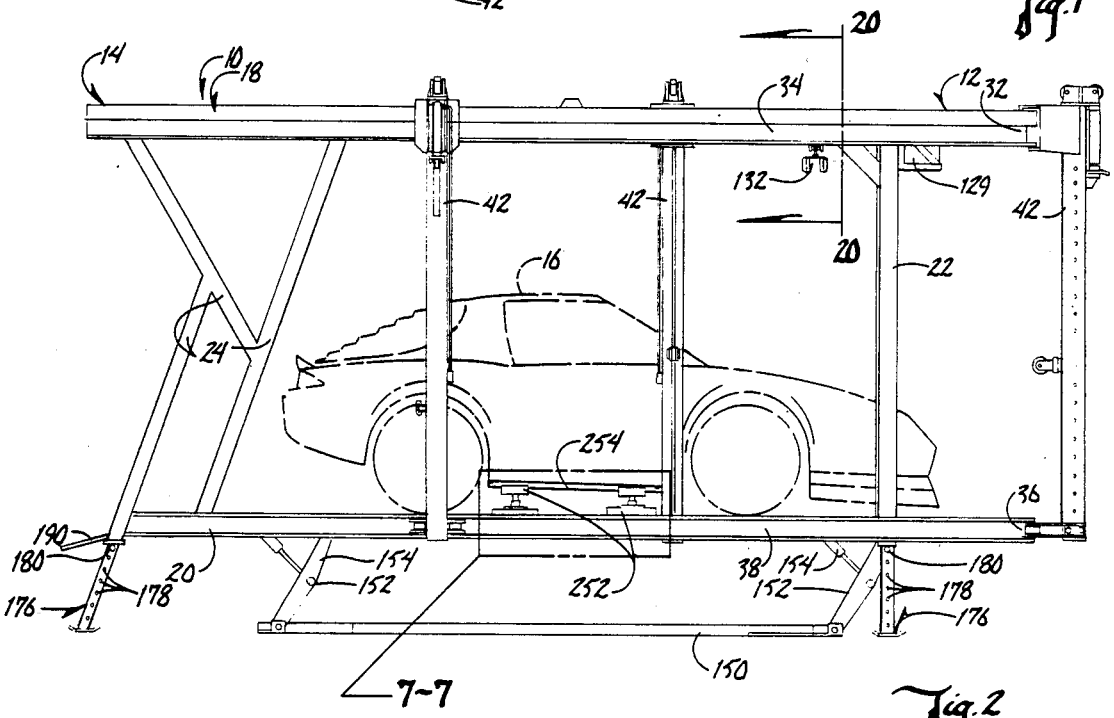
FIG. 2 a side elevation view of the apparatus in the raised position.
Figure 3:
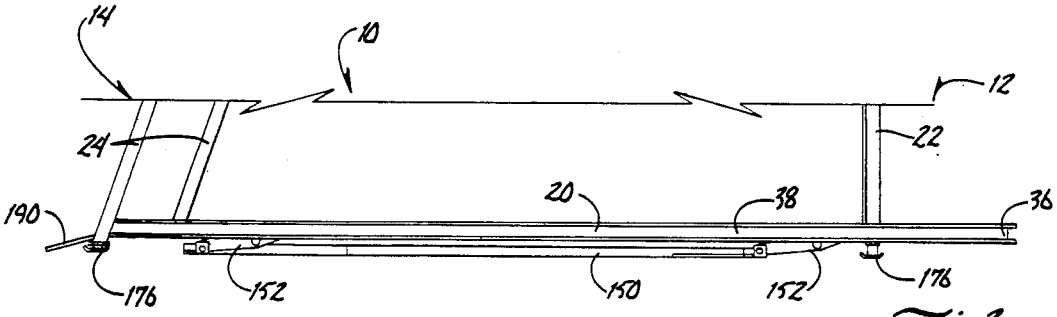
FIG. 3 is a side elevation view of the apparatus in the lowered position.
Figure 6:
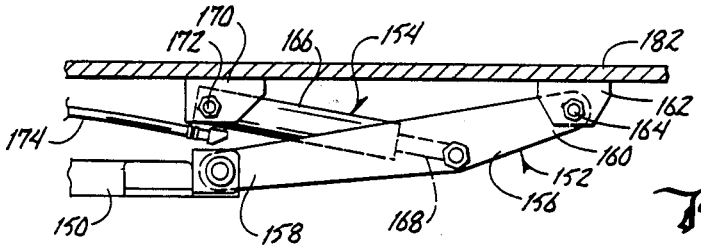
FIG. 6 is a side elevation view showing one of the linkage arm connections of the lifting mechanism of the apparatus in a lowered position.
Figure 7:
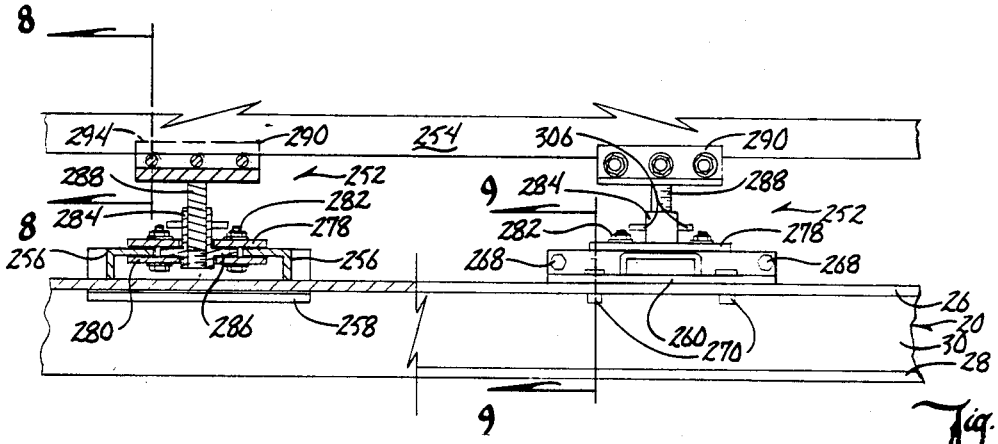
FIG. 7 is a partial sectional view taken along line 7—7 of FIG. 2 showing the tie down units of the apparatus for use on a unibody vehicle.
Figure 8:
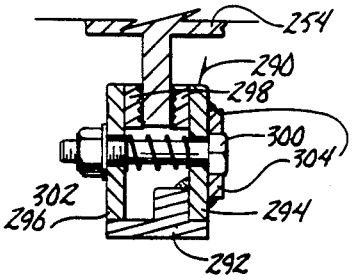
FIG. 8 is a sectional view taken along line 8—8 of FIG. 7.
Figure 9:
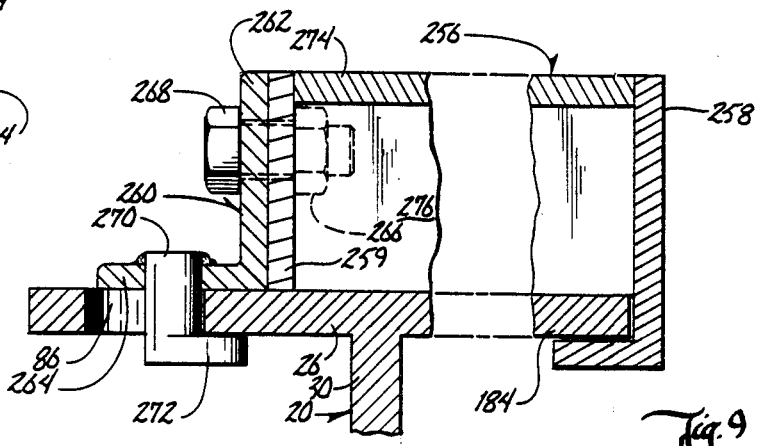
FIG. 9 a sectional view taken along line 9—9 of FIG. 7.

When piston 168 is fully retracted, tracks 18 and 20 and tower assemblies 42 are in a lowered position, as best seen in FIGS. 3 and 6. When pistons 168 are extended from cylinders 166, the tracks and tower assemblies are raised above the floor to provide access to the underneath side of vehicle 16, as seen in FIGS. 2 and 5. A fluid line 174 supplies hydraulic fluid from hydraulic fluid source 129 to the interiors of all cylinders 166 simultaneously. Thus, the plurality of hydraulic power means 154 operate in unison to raise and lower the tracks and tower assemblies of apparatus 10. A single valve (not shown) is provided in fluid line 174 to regulate the supply of fluid to cylinders 166.

As seen in FIG. 2, front frame members 22 and rear frame members 24 may each have a safety leg 176 slidably mounted therein to support the structure after it has been raised to the desired elevation. Safety legs 176 include a plurality of holes 178 along the length thereof through which a pin 180 extends to lock saftey legs 176 in the appropriate position. In operation, hydraulic power means 154 are actuated to raise upper track 18, lower track 20 and tower assemblies 42 slightly above the desired elevation, pin 180 is inserted into the appropriate hole 178 in each safety leg 176, and some pressure is released from cylinders 166 so that the structure will lower slightly onto pins 180 and be supported thereby. The lifting ability of apparatus 10 thus permits the apparatus to be placed on any flat floor without the need of a pit therein. Furthermore, because the entire apparatus sits upon the floor, with no need for infloor hydraulics or the like, the installation of apparatus 10 is greatly simplified.

Apparatus 10 has a vehicle support surface consisting of two spaced apart elongated plates 182 extending inwardly from and along the length of side members 38 of lower track 20. A pair of I-beams 184 extend along the length of apparatus 10 and provide an inner support for each support plate 182. Each support plate 182 has a rearward end 186 having a plurality of holes 188 therein adapted to receive a chain or the like to tie down the rearward end of vehicle 16. Extending rearwardly from rearward end 186 of each support plate 182 is a ramp 190 which facilitates the entry of vehicle 16 upon support plates 182. Central I-beams 184 each have an upper flange 192, a lower flange 194 and an interconnecting central web 196.

A variety of accessories can be used to facilitate work on a damaged vehicle. A first tie down bracket 200 shown in FIGS. 11 and 19 can be used to retain vehicle 16 in position upon support plates 182. Bracket 200 includes a T-shaped member 202 whose length is approximately equal to support plate 182. One end of T-shaped member 202 has an L-shaped member 204 rigidly attached thereto. A plate 206 having a threaded shaft 208 extending therefrom is fixed to the opposite end of T-shaped member 202. A second L-shaped member 210 has a hole therein for receiving shaft 208 and is held in place thereon by a nut 212 threaded onto shaft 208. In use, tie down bracket 200 is positioned over support plate 182 such that L-shaped member 204 overlaps the inner edge of upper flange 192 of central I-beam 184. Second L-shaped member 210 is then placed on shaft 208 so as to overlap the outer edge of upper flange 26 of lower track 20 and nut 212 is loosely threaded onto shaft 208. Bracket 200 can then be slid along support plate 182 to any desired position. Nut 212 is tightly threaded onto shaft 208 to lock bracket 200 in the selected position. T-shaped member 202 includes a plurality of holes 214 along the length thereof. A clevis 216 can be placed over member 202 and held in place thereon by a pin 218 extending through one of holes 214. A chain or the like can then be wrapped around the frame of vehicle 16 and through clevis 216 and secured thereto to hold vehicle 16 down upon support plates 182.

Figure 16:
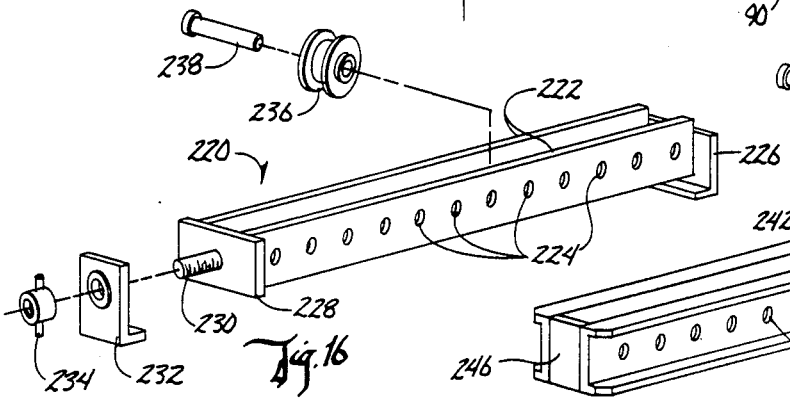
FIG. 16 is a perspective view of one type of pulley bracket.
Figure 19:
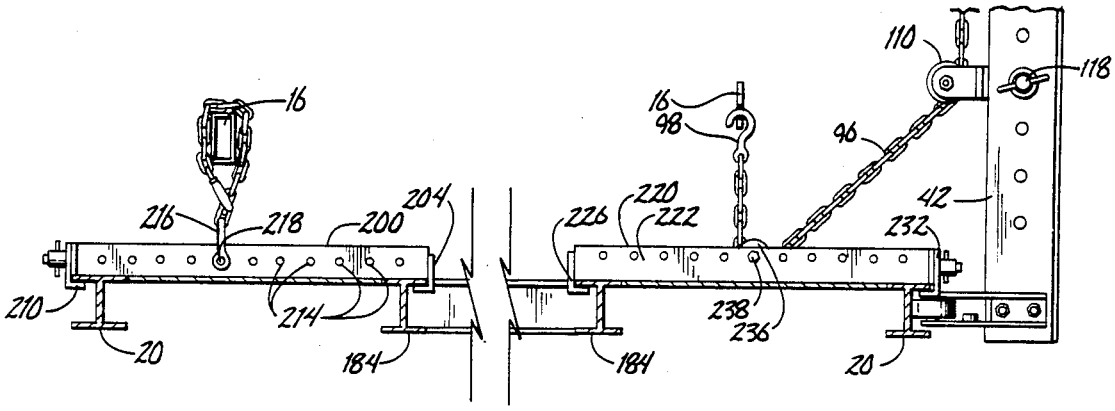
FIG. 19 is a view showing the use of the bracket assemblies shown in FIGS. 11 and 17.
Figure 20:
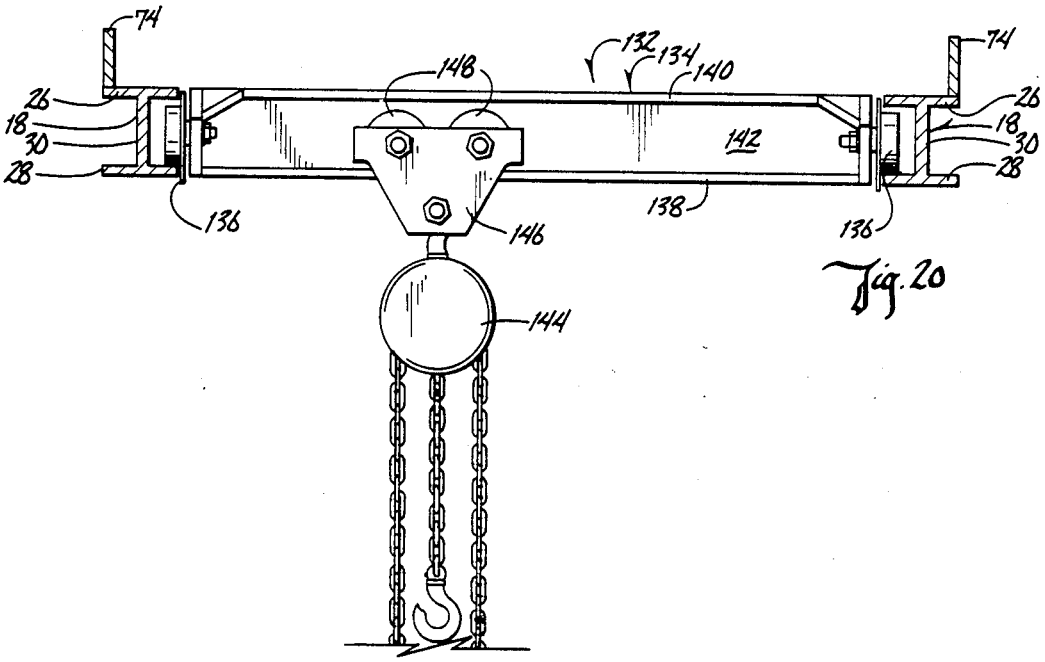
FIG. 20 is a view showing the use of the overhead hoist.

A second tie down bracket 220 shown in FIGS. 16 and 19, is similar to tie down bracket 200 but has a pair of spaced apart elongated bars 222 having a plurality of holes 224 along the length thereof. An L-shaped member 226 is fixed to one end of bars 222 while a plate 228 with the threaded shaft 230 thereon is fixed to the opposite end of bars 222. A second L-shaped member 232 having a hole therein fits over shaft 230 and is held in place thereon by a nut 234. Bracket 220 fits over the inner edge of upper flange 192 of central I-beam 184 and over the outer edge of upper flange 26 of lower track 20 and is secured in place in the same manner as tie down bracket 200. A pulley 236 can be placed between bars 222 and be held in place therebetween by a pin 238 extending through holes 222 therein. Tension member 96 can be trained under pulley 236 and upwardly to vehicle 16 to exert a downward force upon the damaged part of vehicle 16.

Figures 10, 11, 12, 13:
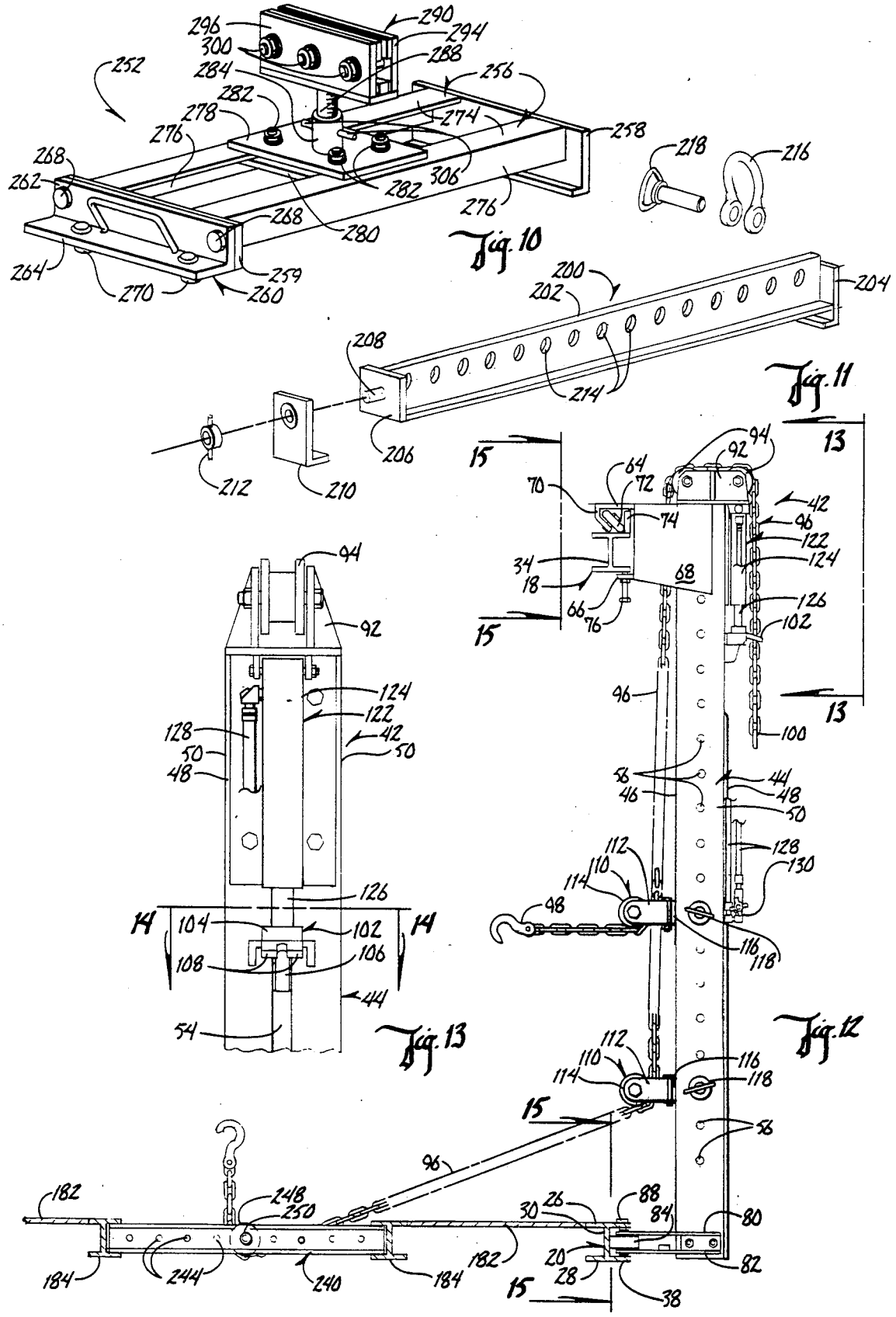
FIG. 10 is a perspective view of the tie down unit used on unibody vehicles.
FIG. 11 is a perspective view of a tie down unit for use on full frame vehicles
FIG. 12 is a partial sectional end elevation view of the tower assembly of the apparatus.
FIG. 13 is a partial side elevation view showing the upper end of one of the tower assemblies.
Figure 14:
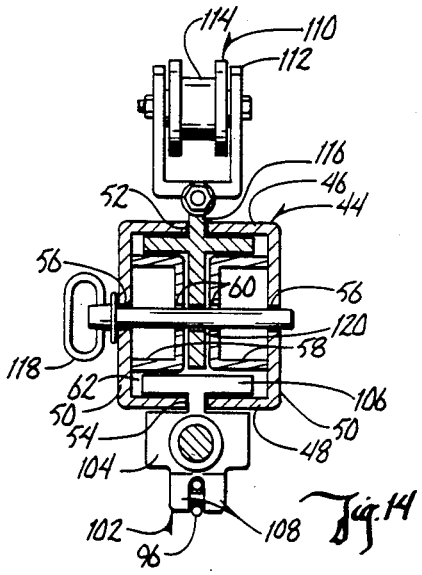
FIG. 14. is a sectional view of a tower assembly taken along line 14—14 of FIG. 13.
Figure 15:
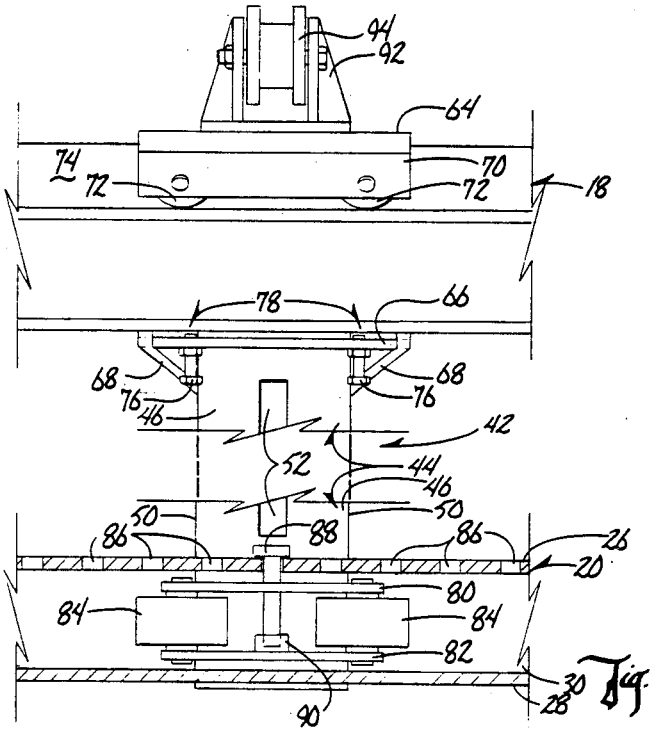
FIG. 15 is a partial sectional elevational view of a tower assembly taken along line 15—15 of FIG. 12.
Figure 17:
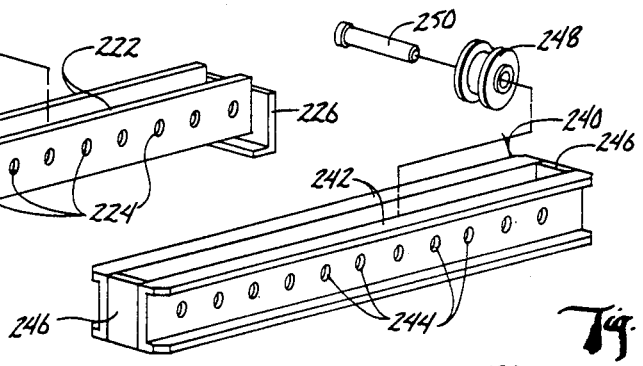
FIG. 17 is a perspective view of another pulley bracket.

A third bracket member 240 can be positioned between central I-beams 184 and held in place therebetween by the inward edges of upper flange 192 and lower flange 194 thereof. As seen in FIGS. 12 and 17, bracket 240 includes a pair of oppositely disposed C-shaped members 242 having a plurality of holes 244 along the length thereof. C-shaped members 242 are spaced apart by a plate 246 at either end thereof. As with bracket 220, a pulley 248 can be positioned between C-shaped members 242 and held in place therebetween by a pin 250 such that tension member 96 can be trained thereabout to exert a downward force upon a damaged portion of vehicle 16. The length of bracket 240 is approximately equal to the distance between central webs 196 of the two central I-beams 184. When tension member 96 is exerting a force from vehicle 16, the upper flanges 192 of I-beams 184 retains bracket 240 in place. When tension member 96 is not under tension, bracket 240 is free to slide along the length of central I-beams 184 and can be removed therefrom by simply turning bracket 240 in a horizontal plane until the opposite ends disengage upper flanges 192 of the opposite I-beams 184. To facilitate the removal of bracket 240, the corners thereof may be bevelled or rounded as best shown in FIG. 17.

Newer vehicles with unibody construction present a novel problem in tying down the vehicle to the support plates 182 because such a vehicle does not have a conventional frame about which a chain or the like can be wrapped to hold the vehicle down. To resolve this problem, a unibody tie down bracket 252 is provided which clamps the rocker panel 254 of a unibody vehicle. Bracket 252 includes a pair of spaced apart angle irons 256 whose lengths are approximately equal to the width of support plate 182. An L-shaped member 258 is attached to one end of angle irons 256 and is adapted to overlap the inner edge of upper flange 192 of central I-beam 184 similarly to L-shaped member 204 of tie down bracket 200. A flat plate 259 is attached to the opposite ends of angle irons 256. A third angle iron 260 has a vertical flange 262 and an integrally formed horizontal flange 264. A nut 266 is welded onto the inside of plate 259 to threadably receive a bolt 268 extending through aligned holes in vertical flange 262 and flat plate 259. A pin or carriage bolt 270 extends through a hole in horizontal flange 264 and is welded in place. Pin 270 has an increased diameter portion 272 which fits through one of holes 86 on upper flange 26 of lower track 20 for retentive engagement with upper flange 26. When bolt 268 is loosened, angle iron 260 can be moved away from plate 259 such that carriage bolt 270 can be removed from hole 86 in upper flange 26 of track 20 thereby allowing bracket 252 to be moved along the length of support surface 182. When carriage bolt 270 extends through hole 86, bolt 268 can be tightened such that unibody tie down bracket 252 will be held in place upon support plate 182.

Angle irons 256 each comprise an inwardly disposed horizontal flange 274 and an integrally formed vertical flange 276. Unibody bracket 252 further includes an upper base plate 278 and a lower base plate 280 positioned on opposite sides of horizontal flanges 274 and adapted to slide along the length of angle irons 256. A plurality of nut and bolt assemblies 282 are tightened to maintain plates 278 an 280 in the desired position along angle irons 256. A vertically disposed collar 284 has a flange 286 connected thereto which is sandwiched between upper base plate 278 and lower base plate 280 but which permits collar 284 to rotate about its longitudinal axis. Threadably received within collar 284 is a shaft 288 upon which a clamp element 290 is mounted. Shaft 288 can be threaded upwardly or downwardly to raise or lower, respectively, clamp element 290. Clamp element 290 comprises a lower member 292, a first jaw 294 rigidly secured to lower member 292 by welding or the like and a second jaw member 296 which is slidable with respect to first jaw member 294. Each jaw has a tooth element 298 attached thereto for securely gripping rocker panel 254 of a unibody vehicle. A plurality of nut and bolt assemblies 300 extend through first and second jaws 294 and 296 and when tightened, pull second jaw 296 inwardly toward first jaw 294 such that teeth elements 298 engage rocker panel 254 to tie vehicle 16 down upon support plates 182.

A spring 302 is positioned on each nut and bolt assembly 300 between first and second jaw members 294 and 296 so as to normally urge second jaw 296 away from first jaw 294. Thus, when the nut is loosened, spring 302 will urge the jaws apart to release rocker panel 254 without the need for prying the jaws apart. One of the jaw member may also include a pair of parallel straps 304 which engage opposite sides of either the nut or bolt extending therethrough so that nut and bolt assembly 300 may be tightened with a single wrench.

To place unibody tie down bracket 252 upon rocker panel 254 of a unibody vehicle, bracket 252 is longitudinally positioned on support surface 182 and base plate 280 is laterally positioned on angle irons 256. Shaft 288 is then manually threaded upwardly until the top of clamp 290 is adjacent the lower edge of rocker panel 254. Clamp element 290 is then positioned such that teeth members 298 are below and on either side of rocker panel 254. Collar 284 is manually turned to extend shaft 288 upwardly a sufficient distance for teeth members 298 to grip rocker panel 254. Nut and bolt assemblies 300 are then tightened such that teeth members 298 securely grip rocker panels 254 and hold vehicle 16 down upon support surface 182. Extensions 306 may be provided upon collar 284 to facilitate the manual rotation thereof. Tie down bracket 252 is thus capable of moving along the length of support plates 282 and across the width thereof for tying down a unibody vehicle. Preferably, four unibody tie down brackets should be used to securely hold the unibody vehicle in place.

It can be seen that apparatus 10 of the present invention permits a vehicle to be driven into and out of the apparatus at ground level and without interference from either track. A single operator can quickly move tower assemblies 42 along the upper and lower tracks 18 and 20, respectively, to the desired positions for connection of tension members 96 to the damaged portion of the vehicle. Upon the application of tension to tension member 96 in a direction inwardly and perpendicular to interior side 46 of tower frame 44, tower frame 44 is pulled against the exterior edges of upper and lower tracks and held in place thereby. Tower assembly 42 will not move longitudinally along tracks 18 and 20 when such a perpendicular force is applied. Upon the application of angular tension in a direction non-perpendicular to interior side 46 of tower frame 44 to tension member 96 of a given tower assembly 42 by the extension of piston 126 from hydraulic cylinder 124 of the same or an oppositely disposed tower assembly, the tower is secured against longitudinal movement along upper track 18 by the frictional bearing engagement against the track by bolts 76 and along lower track 20 by pin 88. Similarly, once the angular tension in tension member 196 is relaxed and pin 88 is removed from lower track 20, the limited lateral free play of the tower relative to upper track 18 enables the contact surfaces to separate such that the tower may again be easily moved to alternate positions for another operation. It is noted that tower assemblies 42 do not rotate and that interior side 46 thereof always faces the interior of the cage structure.

Thus, there has been shown and described an apparatus for repairing and straightening vehicles which accomplishes at least all of the stated objectives.

What is claimed is:

1. An apparatus for repairing and straightening vehicles, comprising:

a cage structure having forward and rearward ends and spaced apart opposite sides and including a vehicle support surface arranged for supporting a vehicle at a position between said opposite sides of said cage structure, a plurality of towers carried by said support surface and movable about said support surface, and means on said towers for applying straightening forces to said vehicle; and lifting means supported directly by a floor for level uniform raising and lowering of the entire cage structure, said lifting means including parallelogram linkage having a floor-engaging base member having forward and rearward ends and opposite sides, a plurality of arms each of which are pivotally connected at opposite ends to said support surface and to said base member adjacent one of the corners thereof, and a hydraulic cylinder connected to said linkage, said cylinder being extended to raise said structure and retracted to lower said structure.

2. The apparatus of claim 1 wherein said lifting means moves said cage structure between a first lowered position and a second raised position and maintain said structure at any elevation therebetween.

3. The apparatus of claim 2 further comprising a plurality of extensible safety legs slidably attached to said cage structure for supporting said structure when said structure is raised from said lowered position.

4. The apparatus of claim 1 wherein said apparatus is portable.

5. The apparatus of claim 1 wherein said cage structure has upper and lower U-shaped tracks, each track including a laterally extended front cross member and a pair of side members connected to opposite ends of the respective front cross member and extended longitudinally therefrom.

6. The apparatus of claim 5 further comprising an overhead hoist slidably mounted between said side members of said upper track for longitudinal movement therealong and transverse movement therebetween.

7. In combination with an apparatus for repairing and straightening a vehicle, said apparatus having a vehicle support surface with forward and rearward ends and spaced apart opposite edges, a vehicle tie down bracket, comprising:

an elongated member having opposite ends and being slidably positioned over said support surface, said elongated member having a plurality of somewhat horizontally disposed holes spaced apart along a majority of the length thereof;

fastening means operably attached to each end of said elongated member securing said elongated member to said support surface, said fastening means being in overlapping engagement with said edges of said support surface;

tensionable means for attachment at one end to a vehicle part and at the other end to said elongated member for anchoring the body part to the elongated member; and means for attaching said tensionable means to any one of said holes in said elongated member for permitting said tensionable means to attach directly below said vehicle part.

8. The tie down bracket of claim 7 wherein said fastening means includes a first L-shaped member fixed to one end of said elongated member and a second L-shaped member releasably secured to the opposite end of said elongated member.

9. The tie down bracket of claim 8 wherein each of said L-shaped members has a lower lip extending under one of said edges of said support surface.

10. Apparatus for repairing and straightening vehicles comprising:

vehicle supporting means for receivingly supporting the wheels of a vehicle;

tower means attached to said vehicle supporting means for pulling on a part of a vehicle disposed on said vehicle supporting means;

lifting means adapted to be supported directly on top of a floor and operably connected to said vehicle supporting means for selectively raising or lowering said vehicle supporting means while maintaining said vehicle supporting means level.

11. The apparatus of claim 10, further comprising:

a support frame means for abutment with a floor;

a first pair of spaced apart lift arms operably pivotally attached at the bottom thereof along a first horizontal axis to said support frame and being operably pivotally attached along a second horizontal axis at the top thereof to said vehicle supporting means;

a first pair of spaced apart hydraulic cylinders having one end thereof operably pivotally attached to said vehicle supporting means along a third horizontal axis and the other ends thereof pivotally attached to respective ones of said lift arms along a fourth horizontal axis, said fourth horizontal axis being disposed through said first pair of spaced apart lift arms intermediate the ends thereof;

a second pair of spaced apart lift arms operably pivotally attached at the bottom thereof along a fifth horizontal axis to said support frame and being operably pivotally attached along a sixth horizontal axis at the top thereof to said vehicle supporting means;

a second pair of spaced apart hydraulic cylinders having one end thereof operably pivotally attached to said vehicle supporting means along a seventh horizontal axis and the other ends thereof pivotally attached to respective ones of said lift arms along an eighth horizontal axis, said eighth horizontal axis being disposed through said second pair of spaced apart lift arms intermediate the ends thereof; and means for keeping said second pair of lift arms disposed parallel to said first pair of lift arms.

12. The apparatus of claim 11, further comprising:

cage means attached to said wheel receiving means for surrounding a vehicle disposed on said vehicle supporting means, said cage means having an upper portion having an upper outer periphery thereon, a lower portion having a lower outer periphery thereon and support means interconnecting said upper and lower portions;

wherein said tower means includes a plurality of tower means operably attached to said cage means for providing anchor points for pulling against auto body parts, each said tower means having an upper portion and a lower portion;

upper track means disposed around a substantial portion of the upper outer periphery of said cage means;

means for operably attaching an upper portion of each of said tower means to said upper track means for permitting said upper portion of said tower to be guided around along said upper track means;

lower track means disposed around a substantial portion of the lower outer periphery of said cage means; and means for operably attaching a lower portion of each of said tower means to said lower track means for permitting said lower portion of said tower to be guided around along said lower track means.

13. The apparatus of claim 12 including safety means connected to said cage means including an elongated member slidably disposed with respect to said cage means for automatically keeping a bottom portion thereof on a support surface and telescoping with respect to said cage means when said cage means is moved up or down by said lifting means.

14. The apparatus of claim 13 including locking means for selectively preventing telescoping of said elongated member when said cage means is at said desired level.

15. The apparatus of claim 14 including second, third and fourth safety means of the type defined in claim 4 disposed at spaced apart positions around said cage means for selectively locking said cage means at a desired level at a total of at least four spaced apart places around the cage means.

16. Apparatus for repairing and straightening vehicles comprising:

vehicle supporting means for receivingly supporting the wheels of a vehicle;

cage means attached to said wheel receiving means for surrounding a vehicle disposed on said vehicle supporting means, said cage means having an upper portion having an upper outer periphery thereon, a lower portion having a lower outer periphery thereon and support means interconnecting said upper and lower portions;

a plurality of tower means operably attached to said cage means for providing anchor points for pulling against auto body parts, each said tower means having an upper portion and a lower portion;

upper track means disposed around a substantial portion of the upper outer periphery of said cage means;

means for operably attaching an upper portion of each of said tower means to said upper track means for permitting said upper portion of said tower to be guided around along said upper track means;

lower track means disposed around a substantial portion of the lower outer periphery of said cage means;

means for operably attaching a lower portion of each of said tower means to said lower track means for permitting said lower portion of said tower to be guided around along said lower track means; and lifting means operably connected to said vehicle supporting means for selectively raising or lowering said vehicle supporting means and cage means while maintaining said vehicle supporting means level.

17. The apparatus of claim 16 wherein said lifting means comprises:

a support frame means for abutment with a floor;

a first pair of spaced apart lift arms operably pivotally attached at the bottom thereof along a first horizontal axis to said support frame and being operably pivotally attached along a second horizontal axis at the top thereof to said vehicle supporting means;

a first pair of spaced apart hydraulic cylinders having one end thereof operably pivotally attached to said vehicle supporting means along a third horizontal axis and the other ends thereof pivotally attached to respective ones of said lift arms along a fourth horizontal axis, said fourth horizontal axis being disposed through said first pair of spaced apart lift arms intermediate the ends thereof;

a second pair of spaced apart lift arms operably pivotally attached at the bottom thereof along a fifth horizontal axis to said support frame and being operably pivotally attached along a sixth horizontal axis at the top thereof to said vehicle supporting means;

a second pair of spaced apart hydraulic cylinders having one end thereof operably pivotally attached to said vehicle supporting means along a seventh horizontal axis and the other ends thereof pivotally attached to respective ones of said lift arms along an eighth horizontal axis, said eighth horizontal axis being disposed through said second pair of spaced apart lift arms intermediate the ends thereof; and means for keeping said second pair of lift arms disposed parallel to said first pair of lift arms.

18. Apparatus for repairing and straightening vehicles comprising:

vehicle supporting means for receivingly supporting the wheels of a vehicle;

tower means operably attached to said vehicle supporting means for providing anchor points for pulling against auto body parts, said tower means having an upper portion and a lower portion, said tower means comprising a substantially vertically disposed beam, said beam including an inner wall facing said vehicle supporting means, an outer wall facing away from said vehicle supporting means and two side walls interconnecting said inner wall and outer wall, a space being formed between said inner wall, outer wall and side walls, first and second guide surfaces being formed within said inner, outer and side walls, a vertically oriented slot being disposed in and through said inner wall and a vertically oriented slot being disposed in and through said outer wall;

flexible means for attachment to said tower at one end thereof and to a vehicle body part on the other end thereof for pulling on such auto body part, said flexible means being tensionable;

holding means operably attached to said outer wall for attaching said one end of the flexible means thereto;

first guide roller means operably attached to a top portion of said beam for receivingly guiding said flexible means over the top of said beam;

hydraulic cylinder means fixed on one end thereof with respect to said first guide roller means for selectively varying the distance between said roller means and said holding means to selectively exert a pulling force on the other end of said flexible means;

second guide roller means for receivingly guiding said flexible means;

bracket means for rotatably attaching said second roller means to said beam;

first extension means connected to said bracket means and extending through the slot in said inner wall of the beam;

first guide means disposed inside of said inner, outer and side walls of said beam for cooperating with said first guide surfaces, said first guide means being connected to said first extension means for permitting said first extension means and bracket means to be vertically moved with respect to said beam;

locking means for selectively locking said guide means in any one of a number of vertically spaced positions;

connection means for attaching said flexible means to the other end of said hydraulic cylinder;

second guide extension means attached to said connection means and extending through the slot in the outer wall; and second guide means disposed inside of said outer, inner and side walls of said beam for cooperating with said second guide surfaces, said second guide means being connected to said second extension means and said connection means to be vertically moved with respect to said beam.

19. The apparatus of claim 7 including a second elongated member disposed parallel to said first elongated member and having a plurality of holes disposed along a majority of the length thereof and having axes aligned with the holes in the first elongated member; and roller means adapted to be rotatably attached to a pair of holes in the first and second elongated members for receiving the tensionable means around the bottom thereof, said tensionable means being flexible.

* * * * *

REEXAMINATION CERTIFICATE (648th)

United States Patent [19]

Field

[11] B1 4,574,614

[45] Certificate Issued Mar. 10, 1987

[54] APPARATUS FOR REPAIRING AND STRAIGHTENING VEHICLES

[75] Inventor: Carl R. Field, Des Moines, Iowa

[73] Assignee: Duz-Mor, Inc., Des Moines, Iowa

Reexamination Request:
No. 90/000,985, Apr. 14, 1986

Reexamination Certificate for:

| | |
|---|---|
| Patent No.: | **4,574,614** |
| Issued: | **Mar. 11, 1986** |
| Appl. No.: | **565,979** |
| Filed: | **Dec. 27, 1983** |

[51] Int. Cl.[4] ..... B21D 1/12

[52] U.S. Cl. ..... 72/447; 72/705; 187/8.72

[58] Field of Search ..... 72/705; 187/8.41, 8.47, 187/8.49, 8.71, 8.72; 254/2 B, 10 R, 10 B, 89 R, 90, 91

[56] References Cited

U.S. PATENT DOCUMENTS

| | | | |
|---|---|---|---|
| 2,201,179 | 5/1940 | Jackson et al. . | |
| 3,317,004 | 5/1967 | Harrison, Jr. . | |
| 3,330,381 | 7/1967 | Halstead | 187/8.72 |
| 3,377,834 | 4/1968 | Latuff et al. | 72/293 |
| 3,518,867 | 7/1970 | Rouis | 72/705 |
| 3,630,066 | 12/1971 | Chisum . | |
| 3,709,330 | 1/1973 | Wells et al. | 187/8.72 |
| 3,724,602 | 4/1973 | Hernick . | |
| 3,985,207 | 10/1976 | Petit | 187/8.5 |
| 4,023,394 | 5/1977 | Borup . | |
| 4,070,899 | 1/1978 | Vanalainen . | |
| 4,151,737 | 5/1979 | Specktor . | |
| 4,203,505 | 5/1980 | Johansson . | |
| 4,267,901 | 5/1981 | Tsujimura . | |
| 4,313,335 | 2/1982 | Eck | 72/457 |
| 4,370,882 | 2/1983 | Labbe | 72/705 |
| 4,447,042 | 5/1984 | Masui . | |
| 4,457,401 | 7/1984 | Taylor et al. . | |

FOREIGN PATENT DOCUMENTS

| | | | |
|---|---|---|---|
| 2412499 | 8/1979 | France | 254/90 |

OTHER PUBLICATIONS

Car Bench International, Car Bench Ltd., Lancaster, England, Mar. 1975.

Rack System Installation Instructions.

May 1, 1986 Letter to Michael O. Sturm from Fred Wiviott.

May 28, 1986 Letter to Michael O. Sturm from Fred Wiviott.

Brochure-Kansas Jack World Rack Operations Manual.

Brochure-Kansas Jack Magna-Rack Operations Manual.

Mar. 28, 1986 Letter to Michael O. Sturm.

Apr. 1, 1986 Letter to Wm. Bruce Day.

*Primary Examiner*—Lowell A. Larson

[57] ABSTRACT

A portable apparatus for repairing and straightening vehicles includes a cage structure having upper and lower spaced apart U-shaped tracks having forward and rearward ends. A plurality of tower assemblies are supported upon the tracks for movement therealong. A hydraulic power means is attached to the exterior of the tower for exerting a downward pulling force upon a tension member trained around a series of pulleys and attached to the damaged portion of the vehicle. The apparatus includes a lifting mechanism on a support surface for level uniform raising and lowering of the entire cage structure to provide access to the underneath side of the vehicle. Various brackets allow downward forces to be applied to the vehicle while an overhead hoist allows upward forces to be applied to the vehicle. A tie down bracket assembly is provided for clamping onto the rocker panels of a unibody vehicle for holding such a vehicle in place upon the supporting surface of the apparatus.

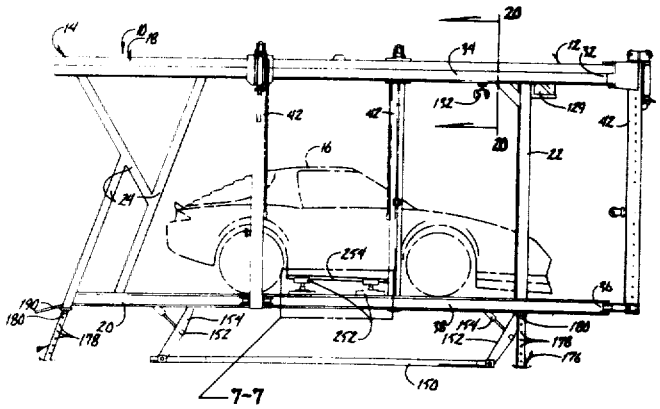

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-9 and 16-19 is confirmed.

Claims 10 and 12 are determined to be patentable as amended.

Claims 11 and 13-15, dependent on an amended claim, are determined to be patentable.

New claim 20 is added and determined to be patentable.

10. Apparatus for repairing and straightening vehicles comprising:

vehicle supporting means for receivingly supporting the wheels of a vehicle, *said vehicle supporting means having a front end, a rear end, sides connected to and between said front and rear ends, a top, a bottom and an exterior periphery around the edges thereof between the top and bottom*;

tower means attached to said vehicle supporting means for pulling *in a mostly horizontal direction* on a part of a vehicle disposed on said vehicle supporting means;

*means connected to said tower means for attachment to a vehicle body;*

*movement means for permitting said tower means to be movable with respect to said vehicle supporting means, said movement means including means for positioning at least a portion of said attachment means directly above any point on the exterior periphery of the support means from one end of said support means, around in each direction from said one end to the sides of said support means; and* lifting means adapted to be supported directly on top of a floor and operably connected to said vehicle supporting means for selectively raising or lowering said vehicle supporting means *and said tower means* while maintaining said vehicle supporting means level.

12. The apparatus of claim 11, further comprising:

cage means attached to said wheel receiving means surrounding a vehicle disposed on said vehicle supporting means, said cage means having an upper portion having an upper outer periphery thereon, a lower portion having a lower outer periphery thereon and support means interconnecting said upper and lower portions;

wherein said tower means includes a plurality of tower means operably attached to said cage means for providing anchor points for pulling against auto body parts, each said tower means having an upper portion and a lower portion;

upper track means disposed around a substantial portion of the upper outer periphery of said cage means;

means for operably attaching an upper portion of each of said tower means to said upper track means for permitting said upper portion of said tower *means* to be guided around along said upper track means;

lower track means disposed around a substantial portion of the lower outer periphery of said cage means; and means for operably attaching a lower portion of each of said tower means to said lower track means for permitting said lower portion of said tower to be guided around along said lower track means.

*20. Apparatus for repairing and straightening vehicles comprising:*

*vehicle supporting means for receivingly supporting the wheels of a vehicle, said supporting means having a front end, a rear end, sides connected to and between said front and rear ends, a top, a bottom and an exterior periphery around the edges thereof between the top and bottom;*

*tower means attached to said vehicle supporting means for pulling in a mostly horizontal direction on a part of a vehicle disposed on said vehicle supporting means;*

*means connected to said tower means for attachment to a vehicle body;*

*movement means for permitting said tower to be movable with respect to said vehicle supporting means, said movement means including means for positioning at least that portion of said tower means having said attachment means connected thereto outwardly from and above any point around at least 180 degrees of the exterior periphery of said support means; and*

*lifting means adapted to be supported directly on top of a floor and operably connected to said vehicle supporting means for selectively raising or lowering said vehicle supporting means and said tower means while maintaining said vehicle supporting means level.*

* * * * *

US004574614B1

REEXAMINATION CERTIFICATE (1619th)

United States Patent [19]

Field

[11] B1, 4,574,614

[45] Certificate Issued Jan. 7, 1992

[54] APPARATUS FOR REPAIRING AND STRAIGHTENING VEHICLES

[75] Inventor: Carl R. Field, Des Moines, Iowa

[73] Assignee: Doz-Mor Inc., Des Moines, Iowa

Reexamination Request:
No. 90/001,775, May 23, 1989
No. 90/001,838, Sep. 8, 1989

Reexamination Certificate for:

| | |
|---|---|
| Patent No.: | **4,574,614** |
| Issued: | **Mar. 11, 1986** |
| Appl. No.: | **565,979** |
| Filed: | **Dec. 27, 1983** |

[51] Int. Cl.[5] ..... B21D 1/12
[52] U.S. Cl. ..... 72/447; 72/705
[58] Field of Search ..... 72/705

[56] References Cited

U.S. PATENT DOCUMENTS

| | | | |
|---|---|---|---|
| 3,583,203 | 6/1971 | Williams et al. | 72/705 |
| 3,835,693 | 9/1974 | Majersky | 72/705 |
| 4,398,410 | 8/1983 | McWhorter et al. | 72/705 |
| 4,516,423 | 5/1985 | Reich | 72/705 |
| 4,592,225 | 6/1986 | Eck . | |
| 4,794,783 | 1/1989 | Eck . | |

OTHER PUBLICATIONS

Photos 1-9 Paulee Universal Bench.
Photo 10-Combination of Marquette Cage and Bear Parallelogram Lift.
Ref. A-"Paulee Universal Bench" brochure.
Ref. B-"Car Bench" brochure.
Ref. C.-"Tech-Cor Inc. Research Bulletin", dated May, 1981, No. 01.81.
Ref. D.-"New Three Directional Swivel Pull Post Car Bench" flyer.
Ref. E-Tir Car flyer "Rifa 'l'incidente all' inverso".
Ref. F-"Marquette CDS/360" flyer.
Ref. G-"DuzMor Inc. Truck Collision Repair System" flyer.
Ref. H-Bradbury "Body Bench Lift A Unique Approach" flyer.
Ref. I-Bear "Allignment Service Equipment" flyer.
Ref. J-Bear "Wheel Alinement and Balancing Equipment" flyer.
Ref. K-David-Bench "1 Carrozzeria 2 Autofficina . . . " flyer.
6-page brochure-BEE LINE re BEE-LINER Model 12,000.

*Primary Examiner*—Lowell A. Larson

[57] ABSTRACT

A portable apparatus for repairing and straightening vehicles includes a cage structure having upper and lower spaced apart U-shaped tracks having forward and rearward ends. A plurality of tower assemblies are supported upon the tracks for movement therealong. A hydraulic power means is attached to the exterior of the tower for exerting a downward pulling force upon a tension member trained around a series of pulleys and attached to the damaged portion of the vehicle. The apparatus includes a lifting mechanism on a support surface for level uniform raising and lowering of the entire cage structure to provide access to the underneath side of the vehicle. Various brackets allow downward forces to be applied to the vehicle while an overhead hoist allows upward forces to be applied to the vehicle. A tie down bracket assembly is provided for clamping onto the rocker panels of a unibody vehicle for holding such a vehicle in place upon the supporting surface of the apparatus.

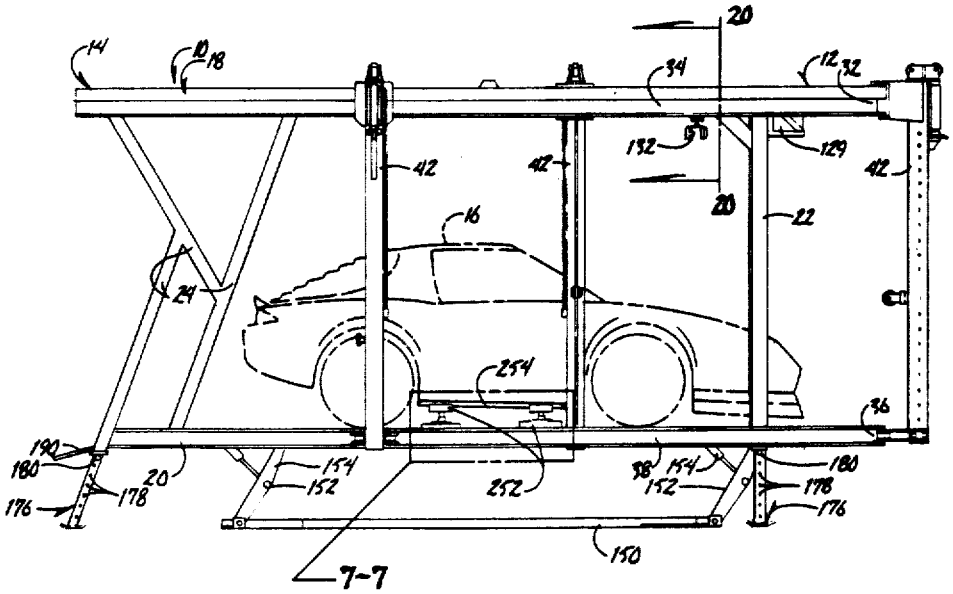

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-20 is confirmed.

New claims 21-46 are added and determined to be patentable.

*21. The apparatus of claim 10 wherein a portion of said vehicle supporting means is disposed directly beneath the wheels of said vehicle disposed thereon; and*

*wherein said portion is an integral part of said vehicle supporting means whereby said portion is not removable from said vehicle supporting means.*

*22. The apparatus of claim 10 wherein said lifting means is disposed directly below said vehicle supporting means and substantially within said exterior periphery of said vehicle supporting means whereby said lifting means does not interfere with movement of said tower means around said exterior periphery.*

*23. The apparatus of claim 10 including points of connection of the lifting means to said vehicle support means wherein all points of connection of said lifting means to said vehicle supporting means are inside of said exterior periphery.*

*24. The apparatus of claim 10 including points of connection of the vehicle supporting means to said tower means wherein said lifting means is disposed inwardly from all points of connection of said tower means to said vehicle supporting means whereby said lifting means does not interfere with the movement of said tower means.*

*25. The apparatus of claim 21 wherein all of said exterior periphery is disposed completely outwardly from said vehicle disposed thereon.*

*26. The apparatus of claim 10 including attaching means for permitting said tower means to move along said exterior periphery of said support means from one end of said support means and around in each direction from said one end and retaining means for maintaining continuous contact between said tower means and said vehicle supporting means while said tower means moves along said exterior periphery.*

*27. The apparatus of claim 26 wherein said attaching means includes rollers operably attached to said tower means for rolling engagement with portions of the exterior periphery of said vehicle supporting means.*

*28. The apparatus of claim 10 wherein said vehicle support means has a lower most working position and an uppermost working position and discreet working positions therebetween;*

*said movement means further including means for permitting at least a portion of said attachment means to be positioned directly above any point on the exterior periphery of the support means from one end of said support means, around in each direction from said one end, to the sides of said support means at any of said working positions between said lowermost and uppermost positions of said vehicle supporting means.*

*29. The apparatus of claim 10 wherein said lifting means has a lowermost working position, an uppermost working position and a working position approximately half way between the lowermost and uppermost positions;*

*said movement means further including means for permitting at least a portion of said attachment means to be positioned directly above any point on the exterior periphery of the support means from one end of said support means, around in each direction from said one end, to the sides of said support means in a working position disposed between said lowermost working position and said half way position.*

*30. Apparatus for repairing and straightening vehicles comprising:*

*vehicle supporting means for receivingly supporting the wheels of a vehicle, said vehicle supporting means having a front end, a rear end, sides connected to and between said front and rear ends, a top, a bottom and an exterior periphery around the edges thereof between the top and bottom;*

*tower means attached to said vehicle supporting means for pulling in a mostly horizontal direction on a part of a vehicle disposed on said vehicle supporting means;*

*means connected to said tower means for attachment to a vehicle body;*

*movement means for permitting said tower means to be movable with respect to said vehicle supporting means, said movement means including means for positioning at least a portion of said attachment means directly above any point on the exterior periphery of the support means from one end of said support means, around in each direction from said one end to the sides of said means, around in each direction from said one end to the sides of said support means while said attachment means is disposed in a straight line between said tower means and said part of said vehicle while using said tower means for pulling; and*

*lifting means adapted to be supported directly on top of a floor and operably connected to said vehicle supporting means for selectively raising or lowering said vehicle supporting means and said tower means while maintaining said vehicle supporting means level.*

*31. Apparatus for repairing and straightening vehicles comprising:*

*vehicle supporting means for receivingly supporting the wheels of a vehicle, said vehicle supporting means having a front end, a rear end, sides connected to and between said front and rear ends, a top, a bottom and an exterior periphery around the edges thereof between the top and bottom, said vehicle support means having a lowermost working position and an uppermost working position and discreet working positions therebetween;*

*tower means attached to said vehicle supporting means for pulling in a mostly horizontal direction on a part of a vehicle disposed on said vehicle supporting means;* means connected to said tower means for attachment to a vehicle body, said attachment means including at least a flexible portion;

*movement means for permitting said tower means to be movable with respect to said vehicle supporting means, said movement means including means for positioning at least a portion of said attachment means directly above any point on the exterior periphery of the support means from one end of said support means,*

*around in each direction from said one end to the sides of said support means while using only one of said tower means for pulling substantially all of the flexible portion of said attachment means between the tower means and said vehicle part to a straight configuration while pulling outwardly in a mostly horizontal direction from said vehicle part;*

*said movement means further including means for permitting at least a portion of said attachment means to be positioned directly above any portion on the exterior periphery of the support means from one end of said support means, around in each direction from said one end, to the sides of said support means at any of said working positions between said lowermost and uppermost positions of said vehicle supporting means; and*

*lifting means adapted to be supported directly on top of a floor and operably connected to said vehicle supporting means for selectively raising or lowering said vehicle supporting means and said tower means while maintaining said vehicle supporting means level.*

*32. The apparatus of claim 20 wherein a portion of said vehicle supporting means is disposed directly beneath the wheels of said vehicle disposed thereon; and*

*wherein said portion is an integral part of said vehicle supporting means whereby said portion is not removable from said vehicle supporting means.*

*33. The apparatus of claim 20 wherein said lifting means is disposed directly below said vehicle supporting means and substantially within said exterior periphery of said vehicle supporting means whereby said lifting means does not interfere with movement of said tower means around said exterior periphery.*

*34. The apparatus of claim 20 including points of connection of the lifting means to said vehicle support means wherein all points of connection of said lifting means to said vehicle supporting means are inside of said exterior periphery.*

*35. The apparatus of claim 20 including points of connection of the vehicle supporting means to said tower means wherein said lifting means is disposed inwardly from all points of connection of said tower means to said vehicle supporting means whereby said lifting means does not interfere with the movement of said tower means.*

*36. The apparatus of claim 35 wherein all of said exterior periphery is disposed completely outwardly from said vehicle disposed thereon.*

*37. The apparatus of claim 20 including attaching means for permitting said tower means to move along said exterior periphery of said support means from one end of said support means and around in each direction from said one end, and retaining means for maintaining continuous contact between said tower means and said vehicle supporting means while said tower means moves along said exterior periphery.*

*38. The apparatus of claim 37 wherein said attaching means includes rollers operably attached to said tower means for rolling engagement with portions of the exterior periphery of said vehicle supporting means.*

*39. The apparatus of claim 20 wherein said vehicle support means has a lowermost working position and an uppermost working position and discreet working positions therebetween;*

*said movement means further including means for permitting at least that portion of said tower means having said attachment means connected thereto to be positioned outwardly from and above any point around at least 180 degrees of the exterior periphery of said support means at any of said working positions between said lowermost and uppermost positions of said vehicle supporting means.*

*40. The apparatus of claim 20 wherein said lifting means has a lowermost working position, an uppermost working position and a working position approximately half way between the lowermost and uppermost positions;*

*said movement means further including means for permitting at least that portion of said tower means having said attachment means connected thereto to be positioned outwardly from and above any point around at least 180 degrees of the exterior periphery of said support means in a working position disposed between said lowermost working position and said half way position.*

*41. Apparatus for repairing and straightening vehicles comprising:*

*vehicle supporting means for receivingly supporting the wheels of a vehicle, said vehicle supporting means having a front end, a rear end, sides connected to and between said front and rear ends, a top, a bottom and an exterior periphery around the edges thereof between the top and bottom;*

*tower means attached to said vehicle supporting means for pulling in a mostly horizontal direction on a part of a vehicle disposed on said vehicle supporting means;*

*means connected to said tower means for attachment to a vehicle body;*

*movement means for permitting said tower means to be movable with respect to said vehicle supporting means, said movement means including means for positioning at least that portion of said tower means having said attachment means connected thereto outwardly from and above any point around at least 180 degrees of the exterior periphery of said support means while said attachment means is disposed in a straight line between said tower means and said part of said vehicle while using said tower means for pulling; and*

*lifting means adapted to be supported directly on top of a floor and operably connected to said vehicle supporting means for selectively raising or lowering said vehicle supporting means and said tower means while maintaining said vehicle supporting means level.*

*42. Apparatus for repairing and straightening vehicles comprising:*

*vehicle supporting means for receivingly supporting the wheels of a vehicle, said vehicle supporting means having a front end, a rear end, sides connected to and between said front and rear ends, a top, a bottom and an exterior periphery around the edges thereof between the top and bottom, said vehicle support means having a lowermost working position and an uppermost working position and discreet working positions therebetween;*

*tower means attached to said vehicle supporting means for pulling in a mostly horizontal direction on a part of a vehicle disposed on said vehicle supporting means;*

*means connected to said tower means for attachment to a vehicle body, said attachment means including at least a flexible portion;*

*movement means for permitting said tower means to be movable with respect to said vehicle supporting means, said movement means including means for positioning at least that portion of said tower means having said attachment means connected thereto outwardly from and above any point around at least 180 degrees of the exterior periphery of said support means while using only one of said tower means for pulling substantially*

*all of the flexible portion of said attachment means between the tower means and said vehicle part to a straight configuration while pulling outwardly in a mostly horizontal direction from said vehicle part;*

*said movement means further including means for permitting at least that portion of said tower means having said attachment means connected thereto to be positioned outwardly from and above any point around at least 180 degrees of the exterior periphery of said support means at any of said working positions between said lowermost and uppermost positions of said vehicle supporting means; and*

*lifting means adapted to be supported directily on top of a floor and operably connected to said vehicle supporting means for selectively raising or lowering said vehicle supporting means and said tower means while maintaining said vehicle supporting means level.*

*43. The apparatus of claim 10 including:*

*means for attaching said tower means directly to said vehicle supporting means and wherein said means for attaching said tower means to said vehicle supporting means is disposed entirely above said bottom of said vehicle supporting means.*

*44. The apparatus of claim 10 wherein the lowermost portion of said tower means is at substantially the same elevation as said bottom of the vehicle supporting means.*

*45. Apparatus comprising:*

*a vehicle having wheels attached thereto;*

*a platform having an outer peripheral edge and having a front portion and a rear portion, said wheels being disposed on said platform;*

*a pulling tower;*

*means for attaching said pulling tower directly to said outer peripheral edge of the platform;*

*means connected to said tower for attachment to said vehicle; and*

*a lift, including:*

*a first arm pivotally attached to said front portion of said platform and movable between a first raised position and a second lowered position;*

*a second arm pivotally attached to said rear portion of said platform and movable between a first raised position and a second lowered position; and*

*means for moving said first arm and said second arm simultaneously for selectively raising or lowering said platform and said tower while maintaining said platform level.*

*46. The apparatus of claim 10 including*

*means for preventing said tower means from moving toward said vehicle supporting means when said tower means is pulling on said vehicle part.*

* * * * *